United States Patent [19]

Takahara et al.

[11] 4,183,716

[45] Jan. 15, 1980

[54] AIR-COOLED TURBINE BLADE

[75] Inventors: Kitao Takahara, Tachikawa; Hiroyuki Nose, Tokyo; Makoto Sasaki, Komae; Kimio Sakata, Chofu, all of Japan

[73] Assignee: The Director of National Aerospace Laboratory of Science and Technology Agency, Toshio Kawasaki, Tokyo, Japan

[21] Appl. No.: 866,819

[22] Filed: Jan. 4, 1978

[30] Foreign Application Priority Data

Jan. 20, 1977 [JP] Japan ..... 52/5352

[51] Int. Cl.[2] ..... F01D 5/18

[52] U.S. Cl. ..... 416/96 A; 416/97 R; 415/115

[58] Field of Search ..... 416/96, 96 A, 97; 415/115, 116

[56] References Cited

U.S. PATENT DOCUMENTS

| | | | |
|---|---|---|---|
| 3,388,888 | 6/1968 | Kercher et al. | 416/96 |
| 3,700,348 | 10/1972 | Corsmeier et al. | 416/96 |
| 3,836,283 | 9/1974 | Matsuki et al. | 416/96 |
| 3,930,748 | 1/1976 | Redman et al. | 415/115 |
| 3,994,622 | 11/1976 | Schultz et al. | 416/97 |
| 4,025,226 | 5/1977 | Hovan | 415/115 |
| 4,040,767 | 8/1977 | Dierberger et al. | 416/96 |
| 4,063,851 | 12/1977 | Weldon | 416/96 |

*Primary Examiner*—Everette A. Powell, Jr.
*Assistant Examiner*—A. N. Trausch, III
*Attorney, Agent, or Firm*—Shapiro and Shapiro

[57] ABSTRACT

A hollow, air-cooled turbine blade of the type having a plurality of ridges and projections extended inwardly from an interior surface of said blade, an insert snugly fitted into a space defined and supported by the ridges and projections and cooling air passages for communicating the space inside the insert with an exterior blade surface, said air passage including a first passage for communicating the space through a space defined between the insert and a wall of the blade with the exterior blade surface and a second air passage for communicating the space within the insert through at least some of the projections directly with the exterior blade surface.

4 Claims, 2 Drawing Figures

AIR-COOLED TURBINE BLADE

BACKGROUND OF THE INVENTION

The present invention relates to a construction of an air cool turbine blade more particularly for use in the high-temperature stage of a gas turbine.

It has been well known in the art that maintaining high gas temperatures at the turbine inlet is one of the ways of reducing the specific fuel consumption and increasing the specific output of the gas turbine. To this end, the gas having extremely high temperatures in excess of allowable or tolerable temperature limits of the components of turbine blades is made to flow into the turbine inlet so that the turbine blades must be cooled.

Cooling methods which are very effective for cooling turbine blades in practice includes so-called convection cooling wherein cooling air from a compressor outlet is made to flow along the interior wall surfaces of a hollow turbine blade; so-called impingement cooling wherein jets of cooling air are impinged against the interior wall surfaces and socalled film cooling wherein cooling air is made to issue from the interior of the turbine blade and to flow along the blade surfaces to form films of cooling air. It is of course preferable to combine various cooling methods rather than to employ a single cooling system.

According to one prior art turbine blade cooling system, an insert formed with a large number of impingement holes is inserted in a hollow blade and is spaced apart therefrom a suitable distance so that a space of a suitable volume may be defined therebetween. Cooling air from a compressor outlet is introduced into the space within the insert and issues through the impingement holes to impinge against the interior wall surfaces in the space, thereby attaining impingement cooling. Thereafter cooling air is made to flow through this space so that convection cooling of the interior wall surfaces of the blade may be attained, and then cooling air is made to issue through ejection holes or slots formed through the wall of the blade to flow along the exterior surfaces, thereby forming films of cooling air and consequently attaining film cooling.

This arrangement utilizes the air passage defined between the insert and the blade in order to attain impingement, convection and film cooling. However, the temperature of cooling air rises after impingement and convection cooling so that satisfactory film cooling effects may not be attained. In some cases, there is only a small pressure difference available between the leading edge of the blade and a cooling air supply source. When such a small pressure difference is distributed for issuing jets of cooling air for impingement cooling, for causing convection cooling and for issuing cooling air for film cooling, the pressure differences assigned for impingement, convection and film cooling becomes further smaller so that neither satisfactory impingement, nor convection, nor film cooling may be attained.

SUMMARY OF THE INVENTION

In view of the above, one of the objects of the present invention is to provide a construction of an air-cooled turbine blade which may substantially solve the above and other problems encountered in the prior art turbine blade cooling systems.

Another object of the present invention is to provide a construction of an air-cooled turbine blade which is most effective and efficient in cooling.

A further object of the present invention is to provide a construction of an air-cooled turbine blade wherein an air passage for impingement cooling and convection cooling is provided independently of an air passage for film cooling so that higher cooling effects and efficiency may be attained.

The above and other objects of the present invention will become more apparent from the following description thereof taken in conjunction with the accompanying drawing.

DESCRIPTION OF THE PREFERRED EMBODIMENT

Figure 1:
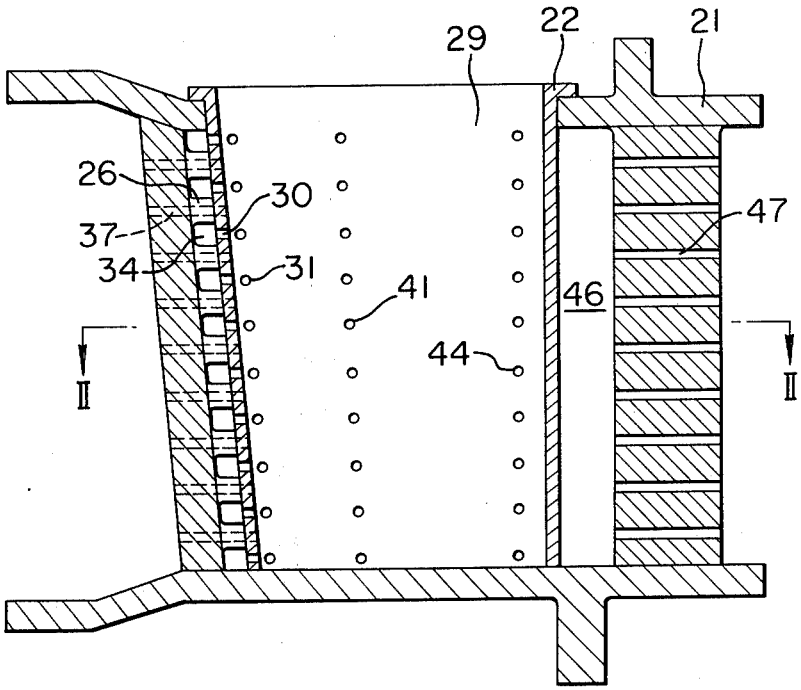
FIG. 1 is a longitudinal sectional view of an aircooled turbine blade in accordance with the present invention.
Figure 2:
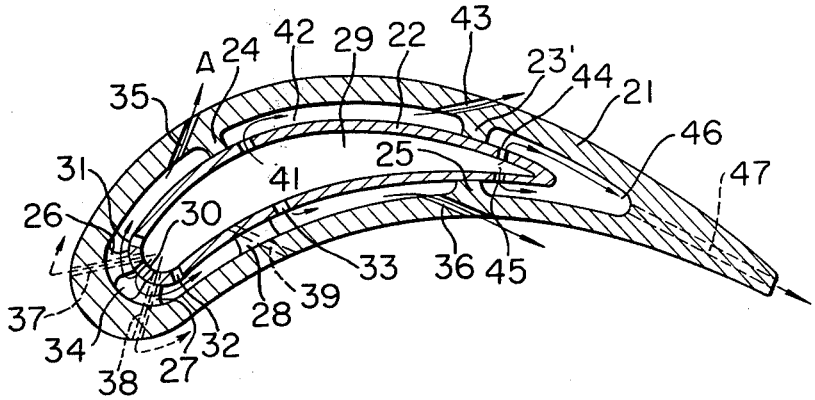
FIG. 2 is a sectional view thereof taken along the line II-II of FIG. 1.

Referring to FIGS. 1 and 2, three spanwise continuous ridges 23, 24 and 25 each with a flat crest are extended inwardly from the interior surfaces of a hollow blade 21 in the direction of its thickness, and a plurality of pin-shaped projections 26, 27 and 28 are inwardly extended from the interior surfaces of the blade 21. A hollow insert 22 is snugly fitted into the space defined by these continuous ridges 23, 24 and 25 and the projections 26, 27 and 28 and is supported by them.

Cooling air from a compressor outlet (not shown) flows through the space 29 within the insert 22, and jets of cooling air issue through a plurality of rows of impingement holes 30, 31, 32 and 33 into the space 34 defined between the wall of the blade 21 and the insert 22 and impinge against the interior surfaces of the blade 21 so that impingement cooling may be attained. Thereafter cooling air flows through the spaces between the pin-shaped projections 26, 27 and 28 and along the interior surfaces of the blade 21 so that convection cooling may be attained. Thereafter cooling air issues through air ejection holes 35 and 36 formed through the walls of the blade 21 and flows along the exterior surfaces of the blade 21 whereby film cooling of the exterior surfaces of the blade 21 downstream of the ejection holes 35 and 36 may be attained. Thus the impingement holes 30, 31, 32 and 33, the space 34 and the ejection holes 35 and 36 constitute a first air passage of the present invention. Since the ejection holes 35 36 are opened at the convex and concave exterior blade surfaces where the exterior pressures are sufficiently low, the pressure distribution in said first air passage is such that satisfactory impingement cooling, convection cooling and film cooling downstream of the ejection holes 35 and 36 may be ensured and high velocities of cooling air flows through the flow passage may be attained so that the high cooling efficiency and effects may be attained.

Part of the cooling air also issues from the space 29 in the insert 22, passes through the wall of the insert; through a plurality of rows of ejection holes 37, 38 and 39 formed through the projections 26, 27 and 28, through the wall of the blade 21, and flows along the exterior surfaces of the blade to form films of cooling air over the exterior blade surfaces whereby film cooling of the exterior blade surfaces may be attained. These ejection holes 37, 38 and 39 constitute a second air passage of the present invention which is independent from the first air passage; that is, the space 29 in the insert 22 is direct comminication with the exterior blade surfaces so that cooling air at low temperatures within the space 29 may be directly used for film cooling. Since the pressure difference between the space 29 within the insert 22 and the exterior blade surfaces may be used as the pressure for causing the cooling air to flow from the space 29 over the exterior blade surfaces, the cooling air may flow in a satisfactory flow rate even at the portions, such as those adjacent to the leading edge and the upstream half of the concave exterior blade surface, where the outer gas pressures are only slightly below the pressure of cooling air at its supply source and therefore, flow rate is attained beyond what had been previously achieved. Accordingly, highly efficient and effective film cooling is ensured.

A prior art blade cooling system may be employed for cooling the convex exterior blade surface and portions adjacent to the trailing edge. A space 42 defined by the spanwise continuous ridges 23 and 24 and the insert 22 is in communication with the space 29 in the insert 22 through an impingement hole 41 formed in the wall of the insert 22, and the space 42 is in communication with the convex exterior blade surface through an ejection hole 43 formed in the wall of the hollow blade 21. In like manner, a space 46 defined by the spanwise continuous ridges 23 and 25 and the insert 22 is communication with the space 29 in the insert 22 through impingement holes 44 and 45 formed in the wall of the insert 22, and the space 46 is in communication with the exterior of the blade through ejection holes 47 extended through the trailing edge of the blade. Therefore cooling air issues from the space 29 in the insert 22 into the spaces 42 and 46 through the impingement holes 41, 44 and 45 so that impingement cooling of the interior blade surfaces within these spaces 42 and 46 may be attained. Thereafter cooling air flows along the interior surfaces in the spaces 42 and 46 whereby convection cooling may be attained. In addition, cooling air is discharged through the ejection holes 43 and 47 whereby exterior film cooling of the convex blade surface aft of the ejection hole 43 may be attained.

The pin-shaped projections 26, 27 and 28 may be of any suitable cross sections such as circular, elliptical or rectangular. The axes of the ejection holes 37, 38 and 39 extended through the pin-shaped projections 26, 27 and 28 may be inclined at any suitable angles relative to the chord of the blade 21 or relative to the direction of blade span thereof. Furthermore a plurality of ejection holes may be extended through each projection.

So far the present invention has been described in conjunction with an air-cooled turbine blade, but it will be understood that the present invention is not limited thereto and may be equally applied for cooling of turbine and bladed rotors of gas turbines and other components subjected to high temperatures.

As described above, because of the provision of the second air passage in accordance with the present invention, highly efficient and effective film, impingement and convection cooling is achieved for the turbine blades exposed to high temperature gas streams even when the difference in pressure between the blade surfaces and the supply source of cooling air is relatively small. When the present invention is applied to air-cooled turbine blades in the high temperature stage of a gas turbine, highly effective and efficient cooling is attained with a less amount of cooling air as compared with the prior art. Therefore the turbine blades can be exposed to high gas temperatures at the turbine inlet with the blades maintained at relatively low temperatures so that the thermal efficiency of the gas turbine may be considerably improved.

While the present invention has been particularly shown and described with reference to the preferred embodiments thereof, it will be understood by those skilled in the art that the foregoing and other changes in form and details can be made therein without departing from the spirit and scope of the present invention.

What is claimed is:

1. In a hollow, air-cooled turbine blade of the type having a plurality of ridges and projections extended inwardly from an interior surface of said blade, an insert snuggly fitted into a space defined by said ridges and projections and supported thereby and cooling air passage means for communicating the space inside said insert with an exterior blade surface, comprising the improvement wherein said cooling air passage means comprises first air passage means for communicating said space through a space defined between said insert and a wall of said blade with the exterior blade surface; and second air passage means for communicating said space within said insert through at least some of said projections directly with the exterior blade surface of said blade.

2. The improvement as claimed in claim 1 wherein said second air passage means is provided in the vicinity of the leading edge of said blade.

3. The improvement as claimed in claim 1 wherein said first air passage means is provided on both sides of the convex and concave surfaces of said turbine blade.

4. The improvement as claimed in claim 1 further characterized in that said second passage means is provided in the vicinity of the leading edge and in the upstream half portion on the concave exterior surface of said turbine blade.

* * * * *